US011572608B2

(12) United States Patent
Kubo et al.

(10) Patent No.: US 11,572,608 B2
(45) Date of Patent: Feb. 7, 2023

(54) ALUMINUM ALLOY THICK PLATE

(71) Applicant: UACJ Corporation, Tokyo (JP)

(72) Inventors: Takashi Kubo, Tokyo (JP); Tatsuya Yamada, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 0 days.

(21) Appl. No.: 17/401,944

(22) Filed: Aug. 13, 2021

(65) Prior Publication Data

US 2021/0371960 A1 Dec. 2, 2021

Related U.S. Application Data

(62) Division of application No. 16/490,774, filed as application No. PCT/JP2018/006449 on Feb. 22, 2018, now Pat. No. 11,124,862.

(30) Foreign Application Priority Data

Mar. 3, 2017 (JP) ..... 2017-040171
Mar. 27, 2017 (JP) ..... 2017-060450

(51) Int. Cl.
*C22C 21/06* (2006.01)
*B22D 11/049* (2006.01)
*C22F 1/047* (2006.01)

(52) U.S. Cl.
CPC ..... *C22C 21/06* (2013.01); *B22D 11/049* (2013.01); *C22F 1/047* (2013.01)

(58) Field of Classification Search
CPC ..... C22C 21/06; B22D 11/04; C22F 1/047
See application file for complete search history.

(56) References Cited

U.S. PATENT DOCUMENTS 3,104,189 A * 9/1963 Nicholas ..... C22C 21/08 148/415
2014/0248177 A1* 9/2014 Kamat ..... C22C 21/08 420/534

FOREIGN PATENT DOCUMENTS

JP 11-320034 A 11/1999
JP 2005-74453 A 3/2005
JP 2005074453 A * 3/2005
(Continued)

OTHER PUBLICATIONS

International Search Report dated May 29, 2018, issued in counterpart International Application No. PCT/JP2018/006449 (1 page).

*Primary Examiner* — Humera N. Sheikh
*Assistant Examiner* — Kevin CT Li
(74) *Attorney, Agent, or Firm* — WHDA, LLP

(57) ABSTRACT

An aluminum alloy thick plate is formed of an aluminum alloy including Mg of 2.0 to 5.0 mass %, and has a plate thickness of 300 to 400 mm. A is 700 pieces/cm$^2$ or less and B is 1.3 times or more as large as A, where (i) A (pieces/cm$^2$) is a maximum value in numbers of crystallized products with a maximum length of 60 μm or more per unit area in each of positions located at a center portion in a thickness direction and at positions of 0.39 Wa to 0.48 Wa in a plate width direction; and (ii) B (pieces/cm$^2$) is a maximum value in numbers of crystallized products with a maximum length of 60 μm or more per unit area in each of positions located at the center portion in the thickness direction and at positions of 0.12 Wa to 0.30 Wa in the plate width direction.

2 Claims, 1 Drawing Sheet

(56) References Cited

FOREIGN PATENT DOCUMENTS

| | | | |
|---|---|---|---|
| JP | 2007-70672 | A | 3/2007 |
| JP | 2009-90372 | A | 4/2009 |
| JP | 2011-214149 | A | 10/2011 |

* cited by examiner

ALUMINUM ALLOY THICK PLATE

CROSS REFERENCE TO RELATED APPLICATIONS

This application is a Division of U.S. patent application Ser. No. 16/490,774, filed Sep. 3, 2019, which is a National Stage Entry of International Application No. PCT/JP2018/006449 filed Feb. 22, 2018, which claims the benefit of Japanese Patent Application Nos. 2017-040171 and 2017-060450 filed in the Japan Patent Office on Mar. 3, 2017 and Mar. 27, 2017, respectively, each of which is incorporated by reference herein in its entirety.

TECHNICAL FIELD

The present invention relates to an aluminum alloy thick plate used for frames of decompression vessels repeating atmospheric pressure and vacuum in solar cell manufacturing apparatuses, liquid crystal panel manufacturing apparatuses, or the like.

BACKGROUND ART

Because repeated stress acts on the frame portions of decompression vessels repeating atmospheric pressure and vacuum, the frame portions are required to have a high fatigue strength property.

Porosities in the material are mentioned as a cause of deterioration in fatigue strength. As another example, porosities and coarse crystallized products in the material are mentioned as a cause of deterioration in fatigue strength. Generally, when a slab is rolled, the porosities inside gradually decrease in size by receiving pressure, and cause no problem in a thin plate. However, in thick plates having a thickness of 300 mm or more with a small reduction, it has been verified that the porosities conversely increase in size in comparison with the porosities in a slab (see Patent Literature 1).

For this reason, in prior art, a 6061 alloy with small porosity quantity is used as the material of frame portions of decompression vessels. For example, Patent Literature 2 discloses using a 6061 alloy as the material of frame portions of decompression vessels.

PRIOR ART LITERATURES

Patent Literature

Patent Literature 1: Japanese Patent Publication 2009-90372-A

Patent Literature 2: Japanese Patent Publication 2011-214149-A

DISCLOSURE OF INVENTION

Problem to be Solved by Invention

However, to achieve required strength in a 6061 alloy, a heat treatment step is required after rolling, and causes a problem of high manufacturing cost.

By contrast, when an Al—Mg-based alloy is used for frame portions of decompression vessels, it becomes unnecessary to perform the heat treatment step, and the manufacturing cost is reduced. By contrast, because Al—Mg based alloys have a high Mg content than that in 6061 alloys, the porosity number in the material increases, and the fatigue strength property is adversely affected.

In addition, in the case of using an Al—Mg-based alloy for a frame portion of a decompression vessel, while the manufacturing cost is reduced because the heat treatment step becomes unnecessary, many intermetallic compounds are crystallized, because an Al—Mg-based alloy is a higher alloy. Such intermetallic compounds include a Mg—Si-based alloy, an Al—Fe-based alloy, an Al—Mn-based alloy, an Al—Fe—Mn-based alloy, and an Al—Fe—Si-based alloy. Because these crystallized intermetallic compounds serve as paths through which fatigue cracks propagate, they have further adverse influence on the fatigue strength property.

For this reason, an object of the present invention is to provide an Al—Mg-based aluminum alloy thick plate suitable as the material for frame portions of decompression vessels and having an excellent fatigue strength property.

Means for Solving the Problem

The problem described above is solved by the present invention described below. Specifically, the present invention (1) provides an aluminum alloy thick plate including an aluminum alloy including Mg of 2.0 to 5.0 mass %. The aluminum alloy thick plate has a plate thickness of 300 to 400 mm. A is 160 pieces/cm$^2$ or less and B is 1.15 times or more as large as A, when Wa is a plate width of the aluminum alloy thick plate in a cross section perpendicular to a casting direction, a 0 position is a center in a plate width direction, a 0.50 Wa position is a plate end in the plate width direction, where (i) A (pieces/cm$^2$) is a maximum value in numbers of porosities with an equivalent circle diameter of 50 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/cm$^2$) is a maximum value in numbers of porosities with an equivalent circle diameter of 50 μm or more per unit area in each of positions located at the center portion in the plate thickness direction and at positions of 0.12 Wa, 0.16 Wa, 0.21 Wa, 0.25 Wa, and 0.30 Wa in the plate width direction.

The present invention (2) provides the aluminum alloy thick plate (1) in which the aluminum alloy includes one or two or more of Ti of 0.15 mass % or less, Cr of 0.35 mass % or less, Mn of 1.00 mass % or less, Fe of 0.40 mass % or less, and Si of 0.40 mass % or less.

The present invention (1) provides an aluminum alloy thick plate including an aluminum alloy including Mg of 2.0 to 5.0 mass % and Fe of 0.4 mass % or less. The aluminum alloy thick plate has a plate thickness of 300 to 400 mm. A is 700 pieces/cm$^2$ or less and B is 1.3 times or more as large as A, when Wa is a plate width of the aluminum alloy thick plate in a cross section perpendicular to a casting direction, a 0 position is a center in a plate width direction, a 0.50 Wa position is a plate end in the plate width direction, where (i) A (pieces/cm$^2$) is a maximum value in numbers of crystallized products with a maximum length of 60 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/cm$^2$) is a maximum value in numbers of crystallized products with a maximum length of 60 μm or more per unit area in each of positions located at the center portion in the plate thickness direction and at positions of 0.12 Wa, 0.16 Wa, 0.21 Wa, 0.25 Wa, and 0.30 Wa in the plate width direction.

The present invention (4) provides the aluminum alloy thick plate (3) in which the aluminum alloy includes one or two or more of Ti of 0.15 mass % or less, Cr of 0.35 mass % or less, Mn of 1.00 mass % or less, and Si of 0.40 mass % or less.

The present invention provides an Al—Mg-based aluminum alloy thick plate suitable as the material for frame portions of decompression vessels and having an excellent fatigue strength property.

Aluminum Alloy Thick Plate of First Mode of Present Invention

An aluminum alloy thick plate according to a first mode of the present invention is an aluminum alloy thick plate formed of an aluminum alloy including Mg of 2.0 to 5.0 mass %, wherein the aluminum alloy thick plate has a plate thickness of 300 to 400 mm, and A is 160 pieces/cm$^2$ or less and B is 1.15 times or more as large as A, when Wa is a plate width of the aluminum alloy thick plate in a section perpendicular to a casting direction, a 0 position is the center in a plate width direction, a 0.50 Wa position is a plate end in the plate width direction, where (i) A (pieces/cm$^2$) is the maximum value in numbers of porosities with an equivalent circle diameter of 50 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/cm$^2$) is the maximum value in numbers of porosities with an equivalent circle diameter of 50 μm or more per unit area in each of positions located at the center portion in the plate thickness direction and at positions of 0.12 Wa, 0.16 Wa, 0.21 Wa, 0.25 Wa, and 0.30 Wa in the plate width direction.

Figure 1:
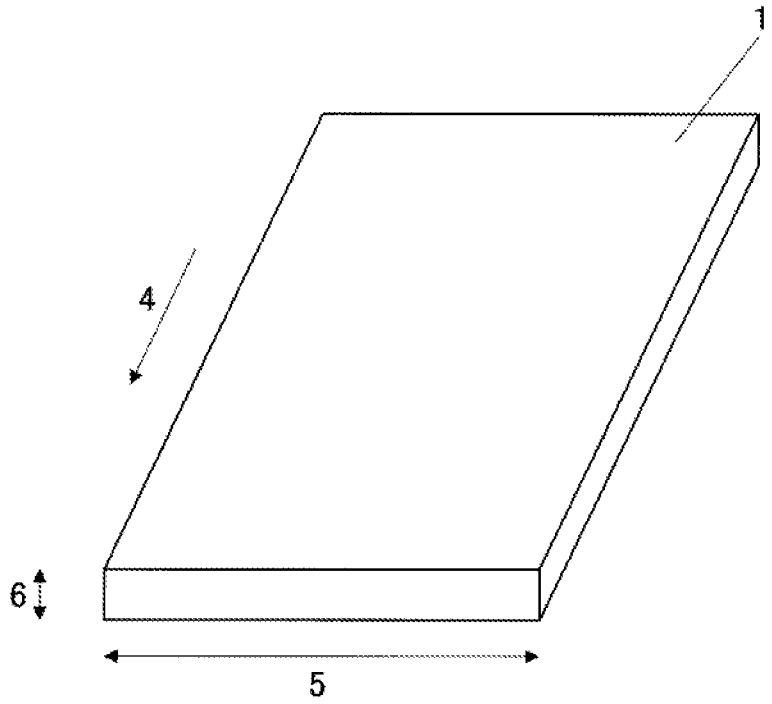
FIG. 1 is a schematic diagram illustrating an example of a mode of an aluminum alloy thick plate according to the present invention.
Figure 2:
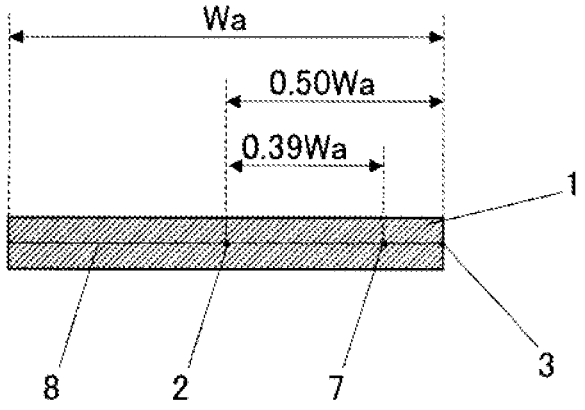
FIG. 2 is a sectional view of the aluminum alloy thick plate of FIG. 1, taken along a plane perpendicular to a casting direction.

The following is an explanation of an aluminum alloy thick plate according to a first mode of the present invention, with reference to FIG. 1 and FIG. 2. FIG. 1 is a schematic diagram and a perspective view of an example of a mode of an aluminum alloy thick plate according to the present invention. FIG. 2 is a sectional view of the aluminum alloy thick plate of FIG. 1, taken along a plane perpendicular to a casting direction. In FIG. 1, an aluminum alloy thick plate 1 is manufactured by casting an ingot of an aluminum alloy adjusted to a predetermined composition, and subjecting the obtained ingot to facing, heating, hot rolling, and cutting.

In FIG. 1, a casting direction 4 is a direction in which the ingot of the aluminum alloy serving as the raw material of the aluminum alloy thick plate 1 is drawn in casting. A plate thickness direction 6 is a thickness direction of the aluminum alloy thick plate 1, and perpendicular to the casting direction 4. A plate width direction 5 is a direction of a width of the aluminum alloy thick plate 1 in a section perpendicular to the casting direction 4, and is a direction perpendicular to the casting direction 4 and perpendicular to the plate thickness direction 6.

In FIG. 2, supposing that a center line 8 is a set of center positions in the plate thickness direction in a section perpendicular to the casting direction, a center portion in the plate thickness direction indicates a portion on the center line 8 and a portion in the vicinity of the center line 8. In addition, suppose that Wa is a plate width of the aluminum alloy thick plate 1 in a section perpendicular to the casting direction, that is, the length of the center line 8, and a 0 position is a position of the center 2 in the plate width direction. In such a case, because a position of a plate end 3 in the plate width direction is a position distant by 0.50 Wa in the plate width direction from the center 2 in the plate width direction, the position of the plate end 3 in the plate width direction serves as a 0.5 Wa position. Accordingly, in FIG. 2, a 0.39 Wa position 7 indicates a position distant by 0.39 Wa in the plate width direction from the 0 position. In the same manner, although they are not illustrated, a 0.40 Wa position is a position distant by 0.40 Wa in the plate width direction from the 0 position, a 0.42 Wa position is a position distant by 0.42 Wa in the plate width direction from the 0 position, a 0.44 Wa position is a position distant by 0.44 Wa in the plate width direction from the 0 position, a 0.46 Wa position is a position distant by 0.46 Wa in the plate width direction from the 0 position, and a 0.48 Wa position is a position distant by 0.48 Wa in the plate width direction from the 0 position.

The aluminum alloy thick plate according to the first mode of the present invention is formed of an aluminum alloy including Mg of 2.0 to 5.0 mass %. Specifically, the aluminum alloy thick plate according to the present invention is formed of an aluminum alloy.

The aluminum alloy of the aluminum alloy thick plate according to the first mode of the present invention is an aluminum alloy including Mg of 2.0 to 5.0 mass %. The Mg content of the aluminum alloy of the aluminum alloy thick plate according to the present invention is preferably 2.0 to 4.2 mass %. Mg has a function of improving strength by being dissolved in Al to form a solid solution. When the Mg content in the aluminum alloy is less than the range described above, the strength increasing effect is small. When the Mg content exceeds the range described above, the solubility of hydrogen in the Al—Mg alloy molten metal increases, a large quantity of porosity is generated, and fatigue strength decreases.

The aluminum alloy of the aluminum alloy thick plate according to the first mode of the present invention may include one or two or more of Ti of 0.15 mass % or less, Cr of 0.35 mass % or less, Mn of 1.00 mass % or less, Fe of 0.40 mass % or less, and Si of 0.40 mass % or less, in addition to Mg of 2.0 to 5.0 mass %, and preferably Mg of 2.0 to 4.2 mass %.

The aluminum alloy of the aluminum alloy thick plate according to the first mode of the present invention may include Ti of 0.15 mass % or less, and preferably Ti of 0.005 to 0.15 mass %. Ti is an element contributing to refinement of the grain structure of the ingot.

The aluminum alloy of the aluminum alloy thick plate according to the first mode of the present invention may include Cr of 0.35 mass % or less, and preferably Cr of 0.01 to 0.35 mass %. Cr has a function of forming an Al—Cr-based compound and refining the grains.

The aluminum alloy of the aluminum alloy thick plate according to the first mode of the present invention may include Mn of 1.00 mass % or less, and preferably Mn of 0.01 to 1.00 mass %. Mn has a function of being dissolved in Al to form a solid solution, simultaneously being dispersed as fine Al—Mn-based precipitates, and improving strength, and a function of refining the grains.

The aluminum alloy of the aluminum alloy thick plate according to the first mode of the present invention may include Fe of 0.40 mass % or less, and preferably Fe of 0.10 to 0.40 mass %. Fe has a function of being dispersed as an Al—Fe-based compound, and refining the grains. In addition, because Fe is one of impurities included in Al, generally, aluminum alloys manufactured industrially include Fe of 0.10 mass % or more as an impurity.

The aluminum alloy of the aluminum alloy thick plate according to the first mode of the present invention may include Si of 0.40 mass % or less, and preferably Si of 0.05 to 0.40 mass %. Because Si is one of impurities included in Al, generally, aluminum alloys manufactured industrially include Si of 0.05 mass % or more as an impurity.

The aluminum alloy of the aluminum alloy thick plate according to the first mode of the present invention may further include Cu of 0.17 mass % or less, Zn of 0.044 mass % or less, and/or Ni of 0.008 mass % or less. As another example, the aluminum alloy of the aluminum alloy thick plate according to the present invention may include impurity elements equal to or smaller than an upper limit value allowed as an impurity of 5000 series aluminum alloys.

For example, an aluminum alloy (1) of a mode example illustrated as follows is mentioned as the aluminum alloy of the aluminum alloy thick plate according to the first mode of the present invention. The aluminum alloy (1) of the aluminum alloy thick plate according to the present invention is an aluminum alloy including Mg of 2.0 to 5.0 mass %, and preferably Mg of 2.0 to 4.2 mass %, with the balance being unavoidable impurities and Al.

The aluminum alloy (1) of the aluminum alloy thick plate according to the first mode of the present invention may further include one or two or more of Ti of 0.15 mass % or less, preferably Ti of 0.005 to 0.15 mass %, Cr of 0.35 mass % or less, preferably Cr of 0.01 to 0.35 mass %, Mn of 1.00 mass % or less, preferably Mn of 0.01 to 1.00 mass %, Fe of 0.40 mass % or less, preferably Fe of 0.10 to 0.40 mass %, and Si of 0.40 mass % or less, preferably Si of 0.05 to 0.40 mass %, in addition to Mg of 2.0 to 5.0 mass %, and preferably Mg of 2.0 to 4.2 mass %.

The aluminum alloy (1) of the aluminum alloy thick plate according to the present invention may further include Cu of 0.17 mass % or less, Zn of 0.044 mass % or less, and/or Ni of 0.008 mass % or less. As another example, the aluminum alloy (1) of the aluminum alloy thick plate according to the present invention may include impurity elements equal to or smaller than an upper limit value allowed as an impurity of 5000 series aluminum alloys.

The aluminum alloy thick plate according to the first mode of the present invention has a plate thickness of 300 to 400 mm. In an aluminum alloy thick plate serving as the material for frames of decompression vessels, the plate thickness with which porosities are not crushed at a rolling step and cause the problem of reduction in fatigue strength is generally 300 to 400 mm.

In the aluminum alloy thick plate according to the first mode of the present invention, A (hereinafter also referred to as "value A of the aluminum alloy thick plate") is 160 pieces/cm$^2$ or less, preferably 100 pieces/cm$^2$ or less, and B (hereinafter also referred to as "value B of the aluminum alloy thick plate") is 1.15 times or more as large as A, and preferably 1.5 times or more as large as A, when Wa is a plate width of the aluminum alloy thick plate in a section perpendicular to a casting direction, a 0 position is the center in a plate width direction, a 0.50 Wa position is a plate end in the plate width direction, where (i) A (pieces/cm$^2$) (value A of the aluminum alloy thick plate) is the maximum value in numbers of porosities with an equivalent circle diameter of 50 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/cm$^2$) (value B of the aluminum alloy thick plate) is the maximum value in numbers of porosities with an equivalent circle diameter of 50 μm or more per unit area in each of positions located at the center portion in the plate thickness direction and at positions of 0.12 Wa, 0.16 Wa, 0.21 Wa, 0.25 Wa, and 0.30 Wa in the plate width direction. As a result of diligent researches performed by the inventors of the present invention, the inventors have found that porosities having an equivalent circle diameter of 50 μm or more have an influence on fatigue strength of frames for decompression vessels manufactured using aluminum alloy thick plates. The inventors of the present invention have also found that the fatigue strength of the acquired frames for decompression vessels increases when the frames for decompression vessels are manufactured using aluminum alloy thick plates having the value A and the value B thereof falling within the ranges described above. Specifically, the fatigue strength of the frames for decompression vessels increases when the value A and the value B of the aluminum alloy thick plate fall within the ranges described above. In addition, in consideration of relation with manufacturing, the lower limit value of the value A of the aluminum alloy thick plate is, for example, preferably 50 pieces/cm$^2$ or more, more preferably 30 pieces/cm$^2$ or more, and particularly preferably 6 pieces/cm$^2$ or more, although the smaller value is more preferable for the value A of the aluminum alloy thick plate, in view of the cooling speed with which a normal ingot is acquired in cooling at the time when the ingot is solidified.

To obtain the value A of the aluminum alloy thick plate, each of positions located at a center portion in the plate thickness direction and at positions of 0.39 Wa, 0.40 Wa, 0.42 Wa, 0.44 Wa, 0.46 Wa, and 0.48 Wa in the plate width direction is observed using an optical microscope with a measurement field of view of 10 mm×10 mm with respect to a section obtained by cutting the aluminum alloy thick plate with a plane perpendicular to the casting direction, porosities with an equivalent circle diameter of 50 μm or more in each of fields of view are extracted, and the numbers (pieces/cm$^2$) of porosities with an equivalent circle diameter of 50 μm or more per unit area are calculated. The maximum value in the calculated values serves as the value A (pieces/cm$^2$) of the aluminum alloy thick plate. In the same manner, to obtain the value B of the aluminum alloy thick plate, each of positions located at the center portion in the plate thickness direction and at positions of 0.12 Wa, 0.16 Wa, 0.21 Wa, 0.25 Wa, and 0.30 Wa in the plate width direction is observed using an optical microscope with a measurement field of view of 10 mm×10 mm with respect to a section obtained by cutting the aluminum alloy thick plate with a plane perpendicular to the casting direction, porosities with an equivalent circle diameter of 50 μm or more in each of fields of view are extracted, and the numbers (pieces/cm$^2$) of porosities with an equivalent circle diameter of 50 μm or more per unit area are calculated. The maximum value in the calculated values serves as the value B (pieces/cm$^2$) of the aluminum alloy thick plate.

The aluminum alloy thick plate according to the first mode of the present invention is manufactured by, for example, a method for manufacturing an aluminum alloy thick plate according to the first mode of the present invention described below. The method for manufacturing an aluminum alloy thick plate according to the first mode of the present invention described below is a mere example for manufacturing the aluminum alloy thick plate according to the first mode of the present invention, and the aluminum alloy thick plate according to the first mode of the present invention is not limited to one manufactured by the method for manufacturing an aluminum alloy thick plate according to the first mode of the present invention described hereinafter.

A method for manufacturing an aluminum alloy thick plate according to the first mode of the present invention is preferably a method comprising casting an ingot of an aluminum alloy having a composition of an aluminum alloy of an aluminum alloy thick plate according to the present invention by direct chill casting, thereafter facing the ingot, heating the ingot, thereafter subjecting the ingot to hot rolling, and thereafter cutting a hot-rolled product to manufacture the aluminum alloy thick plate, wherein in the casting, a hydrogen gas quantity in the molten aluminum alloy is set to 0.15 ml/100 gAl or less, when Wa is a plate width of the aluminum alloy thick plate in a section perpendicular to a casting direction of the manufactured aluminum alloy thick plate, a 0 position is the center in a plate width direction, and a 0.50 Wa position is a plate end in the plate width direction, (iii) a cooling speed for a range of the ingot corresponding to a range of 0.39 Wa to 0.48 Wa at a position in the plate width direction of the manufactured aluminum alloy thick plate is 0.4 to 0.6° C./sec, and (iv) a cooling speed for a range of the ingot corresponding to a range of 0.12 Wa to 0.30 Wa at a position in the plate width direction of the manufactured aluminum alloy thick plate is less than 0.4° C./sec, and the total reduction of the hot rolling is 30 to 60%.

In the method for manufacturing an aluminum alloy thick plate according to the first mode of the present invention, first, direct chill casting is performed to cast an ingot of an aluminum alloy having a composition of the aluminum alloy of the aluminum alloy thick plate according to the present invention.

Direct chill casting of the method for manufacturing an aluminum alloy thick plate according to the first mode of the present invention is performed to cast: (1) an aluminum alloy including Mg of 2.0 to 5.0 mass %, and preferably Mg of 2.0 to 4.2 mass %; or (2) an aluminum alloy including Mg of 2.0 to 5.0 mass %, preferably Mg of 2.0 to 4.2 mass %, and one or two or more of Ti of 0.15 mass % or less, Cr of 0.35 mass % or less, Mn of 1.00 mass % or less, Fe of 0.40 mass % or less, and Si of 0.40 mass % or less. Examples of the aluminum alloy casted by direct chill casting of the method for manufacturing an aluminum alloy thick plate according to the first mode of the present invention include: (3) an aluminum alloy including Mg of 2.0 to 5.0 mass %, and preferably Mg of 2.0 to 4.2 mass %; with the balance being unavoidable impurities and Al; and (4) an aluminum alloy including Mg of 2.0 to 5.0 mass %, preferably Mg of 2.0 to 4.2 mass %, and one or two or more of Ti of 0.15 mass % or less, Cr of 0.35 mass % or less, Mn of 1.00 mass % or less, Fe of 0.40 mass % or less, and Si of 0.40 mass % or less, with the balance being unavoidable impurities and Al.

In direct chill casting of the method for manufacturing an aluminum alloy thick plate according to the first mode of the present invention, molten metal of an aluminum alloy having a predetermined composition is prepared, and subjected to degassing, inclusion removal, and cooling.

In direct chill casting of the method for manufacturing an aluminum alloy thick plate according to the first mode of the present invention, casting is performed, with the hydrogen gas quantity in the molten aluminum alloy set to 0.15 ml/100 gAl or less. With the hydrogen gas quantity in the molten aluminum alloy in casting falling within the range described above, the value A of the aluminum alloy thick plate is controlled to 160 pieces/cm$^2$ or less, and preferably 100 pieces/cm$^2$ or less. By contrast, when the hydrogen gas quantity in the molten aluminum alloy in casting exceeds the range described above, coarse porosities increase, and the fatigue life property in frames for decompression vessels decrease. Examples of the method for controlling the hydrogen gas quantity in the molten aluminum alloy in casting to the range described above include a method of blowing chlorine gas, mixture gas of chlorine gas and inert gas, or inert gas into the molten aluminum alloy.

In direct chill casting of the method for manufacturing an aluminum alloy thick plate according to the first mode of the present invention, when Wa is a plate width of the aluminum alloy thick plate in a section perpendicular to a casting direction of the manufactured aluminum alloy thick plate, a 0 position is the center in a plate width direction, and a 0.50 Wa position is a plate end in the plate width direction, (iii) a cooling speed for a range of the ingot corresponding to a range of 0.39 Wa to 0.48 Wa at a position in the plate width direction of the manufactured aluminum alloy thick plate is 0.4 to 0.6° C./sec, and (iv) a cooling speed for a range of the ingot corresponding to a range of 0.12 Wa to 0.30 Wa at a position in the plate width direction of the manufactured aluminum alloy thick plate is less than 0.4° C./sec. In cooling at the time when the ingot is solidified, by setting: (iii) the cooling speed for a range of the ingot corresponding to a range of 0.39 Wa to 0.48 Wa at a position in the plate width direction of the manufactured aluminum alloy thick plate; and (iv) the cooling speed for a range of the ingot corresponding to a range of 0.12 Wa to 0.30 Wa at a position in the plate width direction of the manufactured aluminum alloy thick plate to the ranges described above, it is possible to set the value A of the aluminum alloy thick plate to 160 pieces/cm$^2$ or less, and preferably 100 pieces/cm$^2$ or less, and set the value B of the aluminum alloy thick plate to 1.15 times or more as large as the value A of the aluminum alloy thick plate, and preferably 1.5 times or more as large as the value A. In the portion corresponding to the portion required to have long fatigue life in the frames of decompression vessels, that is, (iii) the range of the ingot corresponding to a range of 0.39 Wa to 0.48 Wa at a position in the plate width direction of the manufactured aluminum alloy thick plate, the cooling speed is set to a fast speed of 0.4 to 0.6° C./sec. In addition, in a portion corresponding to the portion with no relation to the fatigue life in the frames of decompression vessels, that is, (iv) the range of the ingot corresponding to a range of 0.12 Wa to 0.30 Wa at a position in the plate width direction of the manufactured aluminum alloy thick plate, the cooling speed is set to a slow speed less than 0.4° C./sec. These settings reduce: (iii) occurrence of large-sized porosities in the range of the ingot corresponding to a range of 0.39 Wa to 0.48 Wa at a position in the plate width direction of the manufactured aluminum alloy thick plate; and (iv) concentrates occurrence of the porosities on a portion close to the center beyond 0.30 Wa at a position in the plate width direction of the manufactured aluminum alloy thick plate. This structure reduces the value A of the aluminum alloy thick plate to 160 pieces/cm$^2$ or less, and preferably 100 pieces/cm$^2$ or less. In cooling at the time when the ingot is solidified, it is difficult in direct chill casting due to thermal behavior to set (iii) the cooling speed for a range of the ingot corresponding to a range of 0.39 Wa to 0.48 Wa at a position in the plate width direction of the manufactured aluminum alloy thick plate to a speed exceeding 0.6° C./sec. In addition, in the case of setting (iii) the cooling speed for a range of the ingot corresponding to a range of 0.39 Wa to 0.48 Wa at a position in the plate width direction of the manufactured aluminum alloy thick plate to a speed less than 0.4° C./sec, because the cooling speed is too slow, the dendrite arm space (hereinafter referred to as "DAS") becomes coarse, and porosities generated in the DAS also become coarse. Consequently, the value A of the aluminum alloy thick plate exceeds 160 pieces/$cm^2$.

In direct chill casting of the method for manufacturing an aluminum alloy thick plate according to the first mode of the present invention, as a method for adjusting the cooling speed in cooling at the time when the ingot is solidified, for example, there is a method of increasing the cooling speed for (iii) the range of the ingot corresponding to a range of 0.39 Wa to 0.48 Wa at a position in the plate width direction of the manufactured aluminum alloy thick plate to 0.4 to 0.6° C./sec, by increasing the temperature gradient in a solidification position corresponding to the center portion in the thickness direction of the ingot, in (iii) the range of the ingot corresponding to a range of 0.39 Wa to 0.48 Wa at a position in the plate width direction of the manufactured aluminum alloy thick plate, that is, employing a strong flow of molten aluminum alloy to the center portion in the thickness direction of the ingot, in the position in the width direction of the ingot in (iii) the range of the ingot corresponding to a range of 0.39 Wa to 0.48 Wa at a position in the plate width direction of the manufactured aluminum alloy thick plate, to decrease the temperature gradient in the solidification process, that is, shorten the liquidus temperature position and the solidus temperature position. Specific methods thereof include setting a plurality of molten metal supply nozzles into the cast such that the strong flow of molten aluminum alloy hits the position, setting an in-cast molten metal distributer to a proper size, and/or causing a strong flow of molten aluminum alloy to hit the position with a molten metal pump set in the cast.

In the method for manufacturing an aluminum alloy thick plate according to the first mode of the present invention, after the ingot acquired by direct chill casting is subjected to facing, the faced ingot is heated at 500 to 550° C., and preferably 510 to 540° C., for the purpose of eliminating micro segregation and performing heating before rolling.

Thereafter, in the method for manufacturing an aluminum alloy thick plate according to the first mode of the present invention, the faced and heated ingot is subjected to hot rolling. In hot rolling in the method for manufacturing an aluminum alloy thick plate according to the present invention, the faced and heated ingot is subjected to hot rolling through a plurality of passes at 400 to 510° C., and preferably 450 to 505° C.

In hot rolling in the method for manufacturing an aluminum alloy thick plate according to the first mode of the present invention, the total reduction is 30 to 60%. The total reduction (%) in hot rolling is a ratio of reduction in plate thickness after the final pass to the plate thickness before the first pass of hot rolling, and is a value calculated with "(plate thickness t1 before first pass−plate thickness t2 after final pass)/plate thickness t1 before first pass×100".

The thickness of the ingot before hot rolling in the method for manufacturing an aluminum alloy thick plate according to the first mode of the present invention is preferably 500 to 750 mm.

Thereafter, in the method for manufacturing an aluminum alloy thick plate according to the first mode of the present invention, the hot-rolled product acquired by hot rolling is cut to acquire the aluminum alloy thick plate according to the present invention.

Aluminum Alloy Thick Plate According to Second Mode of Present Invention

An aluminum alloy thick plate according to the second mode of the present invention is an aluminum alloy thick plate formed of an aluminum alloy including Mg of 2.0 to 5.0 mass % and Fe of 0.4 mass % or less, wherein the aluminum alloy thick plate has a plate thickness of 300 to 400 mm, A is 700 pieces/$cm^2$ or less and B is 1.3 times or more as large as A, when Wa is a plate width of the aluminum alloy thick plate in a section perpendicular to a casting direction, a 0 position is the center in a plate width direction, a 0.50 Wa position is a plate end in the plate width direction, where (i) A (pieces/$cm^2$) is the maximum value in numbers of crystallized products with a maximum length of 60 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/$cm^2$) is the maximum value in numbers of crystallized products with a maximum length of 60 μm or more per unit area in each of positions located at the center portion in the plate thickness direction and at positions of 0.12 Wa, 0.16 Wa, 0.21 Wa, 0.25 Wa, and 0.30 Wa in the plate width direction.

The following is an explanation of the aluminum alloy thick plate according to the second mode of the present invention with reference to FIG. 1 and FIG. 2. FIG. 1 is a schematic diagram and a perspective view of an example of a mode of an aluminum alloy thick plate according to the present invention. FIG. 2 is a sectional view of the aluminum alloy thick plate of FIG. 1, taken along a plane perpendicular to a casting direction. In FIG. 1, an aluminum alloy thick plate 1 is manufactured by casting an ingot of an aluminum alloy adjusted to a predetermined composition, and subjecting the obtained ingot to facing, heating, hot rolling, and cutting.

In FIG. 1, a casting direction 4 is a direction in which the ingot of the aluminum alloy serving as the raw material of the aluminum alloy thick plate 1 is drawn in casting. A plate thickness direction 6 is a thickness direction of the aluminum alloy thick plate 1, and perpendicular to the casting direction 4. A plate width direction 5 is a direction of a width of the aluminum alloy thick plate 1 in a section perpendicular to the casting direction 4, and is a direction perpendicular to the casting direction 4 and perpendicular to the plate thickness direction 6.

In FIG. 2, supposing that a center line 8 is a set of center positions in the plate thickness direction in a section perpendicular to the casting direction, a center portion in the plate thickness direction indicates a portion on the center line 8 and a portion in the vicinity of the center line 8. In addition, suppose that Wa is a plate width of the aluminum alloy thick plate 1 in a section perpendicular to the casting direction, that is, the length of the center line 8, and a 0 position is a position of the center 2 in the plate width direction. In such a case, because a position of a plate end 3 in the plate width direction is a position distant by 0.50 Wa in the plate width direction from the center 2 in the plate width direction, the position of the plate end 3 in the plate width direction serves as a 0.5 Wa position. Accordingly, in FIG. 2, a 0.39 Wa position 7 indicates a position distant by 0.39 Wa in the plate width direction from the 0 position. In the same manner, although they are not illustrated, a 0.40 Wa position is a position distant by 0.40 Wa in the plate width direction from the 0 position, a 0.42 Wa position is a position distant by 0.42 Wa in the plate width direction from the 0 position, a 0.44 Wa position is a position distant by 0.44 Wa in the plate width direction from the 0 position, a 0.46 Wa position is a position distant by 0.46 Wa in the plate width direction from the 0 position, and a 0.48 Wa position is a position distant by 0.48 Wa in the plate width direction from the 0 position.

The aluminum alloy thick plate according to the second mode of the present invention is formed of an aluminum alloy including Mg of 2.0 to 5.0 mass %, and 0.4 mass % or less. Specifically, the aluminum alloy thick plate according to the present invention is formed of an aluminum alloy.

The aluminum alloy of the aluminum alloy thick plate according to the second mode of the present invention is an aluminum alloy including Mg of 2.0 to 5.0 mass % and Fe of 0.4 mass % or less. The Mg content of the aluminum alloy of the aluminum alloy thick plate according to the present invention is preferably 2.0 to 4.2 mass %. The Fe content thereof is preferably 0.05 to 0.2 mass %, particularly preferably 0.1 to 2.0 mass %. Mg has a function of improving strength by being dissolved in Al to form a solid solution. When the Mg content in the aluminum alloy is less than the range described above, the strength increasing effect is small. When the Mg content exceeds the range described above, a large number of coarse Al—Mg—Si-based crystallized products and Mg—Si-based crystallized products in the aluminum alloy are generated, and fatigue strength decreases. Fe has a function of being dispersed as an Al—Fe-based compound, and refining the grains. When the Fe content in the aluminum alloy exceeds the range described above, a large number of coarse intermetallic compounds are crystallized, such as an Al—Fe-based compound, an Al—Fe—Mn-based compound, and an Al—Fe—Si-based compound.

The aluminum alloy of the aluminum alloy thick plate according to the second mode of the present invention may include one or two or more of Ti of 0.15 mass % or less, Cr of 0.35 mass % or less, Mn of 1.00 mass % or less, and Si of 0.40 mass % or less, in addition to Mg of 2.0 to 5.0 mass %, preferably Mg of 2.0 to 4.2 mass %, Fe of 0.4 mass % or less, preferably Fe of 0.05 to 0.2 mass %, and particularly preferably Fe of 0.1 to 0.2 mass %.

The aluminum alloy of the aluminum alloy thick plate according to the second mode of the present invention may include Ti of 0.15 mass % or less, and preferably Ti of 0.005 to 0.15 mass %. Ti is an element contributing to refinement of the grain structure of the ingot.

The aluminum alloy of the aluminum alloy thick plate according to the second mode of the present invention may include Cr of 0.35 mass % or less, and preferably Cr of 0.01 to 0.35 mass %. Cr has a function of forming an Al—Cr-based compound and refining the grains.

The aluminum alloy of the aluminum alloy thick plate according to the second mode of the present invention may include Mn of 1.00 mass % or less, and preferably Mn of 0.4 to 1.00 mass %. Mn has a function of being dissolved in Al to form a solid solution, simultaneously being dispersed as fine Al—Mn-based precipitates, and improving strength, and a function of refining the grains.

The aluminum alloy of the aluminum alloy thick plate according to the second mode of the present invention may include Si of 0.40 mass % or less, and preferably Si of 0.05 to 0.40 mass %. Because Si is one of impurities included in Al, generally, aluminum alloys manufactured industrially include Si of 0.05 mass % or more as an impurity.

The aluminum alloy of the aluminum alloy thick plate according to the second mode of the present invention may further include Cu of 0.17 mass % or less, Zn of 0.044 mass % or less, and/or Ni of 0.008 mass % or less. As another example, the aluminum alloy of the aluminum alloy thick plate according to the present invention may include impurity elements equal to or smaller than an upper limit value allowed as an impurity of 5000 series aluminum alloys.

For example, an aluminum alloy (1) of a mode example illustrated as follows is mentioned as the aluminum alloy of the aluminum alloy thick plate according to the second mode of the present invention. The aluminum alloy (1) of the aluminum alloy thick plate according to the present invention is an aluminum alloy including Mg of 2.0 to 5.0 mass %, preferably Mg of 2.0 to 4.2 mass %, and Fe of 0.4 mass % or less, preferably Fe of 0.05 to 0.2 mass %, and particularly preferably Fe of 0.1 to 0.2 mass %, with the balance being unavoidable impurities and Al.

The aluminum alloy (1) of the aluminum alloy thick plate according to the second mode of the present invention may further include one or two or more of Ti of 0.15 mass % or less, preferably Ti of 0.005 to 0.15 mass %, Cr of 0.35 mass % or less, preferably Cr of 0.01 to 0.35 mass %, Mn of 1.00 mass % or less, preferably Mn of 0.01 to 1.00 mass %, and Si of 0.40 mass % or less, preferably Si of 0.05 to 0.40 mass %, in addition to Mg of 2.0 to 5.0 mass %, preferably Mg of 2.0 to 4.2 mass %, and Fe of 0.4 mass % or less, preferably Fe of 0.05 to 0.2 mass %, and particularly preferably Fe of 0.1 to 0.2 mass %.

The aluminum alloy (1) of the aluminum alloy thick plate according to the second mode of the present invention may further include Cu of 0.17 mass % or less, Zn of 0.044 mass % or less, and/or Ni of 0.008 mass % or less. As another example, the aluminum alloy (1) of the aluminum alloy thick plate according to the present invention may include impurity elements equal to or smaller than an upper limit value allowed as an impurity of 5000 series aluminum alloys.

The aluminum alloy thick plate according to the second mode of the present invention has a plate thickness of 300 to 400 mm. In an aluminum alloy thick plate serving as the material for frames of decompression vessels, the plate thickness with which porosities are not crushed at a rolling step and cause the problem of reduction in fatigue strength is generally 300 to 400 mm.

In the aluminum alloy thick plate according to the second mode of the present invention, A is 700 pieces/cm$^2$ or less and B is 1.3 times or more as large as A, and preferably 1.5 times or more as large as A, when Wa is a plate width of the aluminum alloy thick plate in a section perpendicular to a casting direction, a 0 position is the center in a plate width direction, a 0.50 Wa position is a plate end in the plate width direction, where (i) A (pieces/cm$^2$) is the maximum value in numbers of crystallized products with a maximum length of 60 μm or more per unit area in each of positions located at a center portion in a plate thickness direction and at positions of 0.39 Wa, 0.40 Wa, 0.42 Wa, 0.44 Wa, 0.46 Wa, and 0.48 Wa in the plate width direction; and (ii) B (pieces/cm$^2$) is the maximum value in numbers of crystallized products with a maximum length of 60 μm or more per unit area in each of positions located at the center portion in the plate thickness direction and at positions of 0.12 Wa, 0.16 Wa, 0.21 Wa, 0.25 Wa, and 0.30 Wa in the plate width direction. As a result of diligent researches performed by the inventors of the present invention, the inventors have found that crystallized products having the maximum length of 60 μm or more have an influence on fatigue strength of frames for decompression vessels manufactured using aluminum alloy thick plates. The inventors of the present invention have also found that the fatigue strength of the acquired frames for decompression vessels increases when the frames for decompression vessels are manufactured using aluminum alloy thick plates having the value A and the value B thereof falling within the ranges described above. Specifically, the fatigue strength of the frames for decompression vessels increases when the value A and the value B of the aluminum alloy thick plate fall within the ranges described above. In addition, in consideration of relation with manufacturing, the lower limit value of the value A of the aluminum alloy thick plate is, for example, preferably 500 pieces/$cm^2$ or more, more preferably 300 pieces/$cm^2$ or more, particularly and preferably 150 pieces/$cm^2$ or more, although the smaller value is more preferable for the value A of the aluminum alloy thick plate, in view of the cooling speed with which a normal ingot is acquired in cooling at the time when the ingot is solidified.

To obtain the value A of the aluminum alloy thick plate, each of positions located at a center portion in the plate thickness direction and at positions of 0.39 Wa, 0.40 Wa, 0.42 Wa, 0.44 Wa, 0.46 Wa, and 0.48 Wa in the plate width direction is observed using an optical microscope with a measurement field of view of 10 mm×10 mm with respect to a section obtained by cutting the aluminum alloy thick plate with a plane perpendicular to the casting direction, crystallized products with a maximum length of 60 μm or more in each of fields of view are extracted, and the numbers (pieces/$cm^2$) of crystallized products with a maximum length of 60 μm or more per unit area are calculated. The maximum value in the calculated values serves as the value A (pieces/$cm^2$) of the aluminum alloy thick plate. In the same manner, to obtain the value B of the aluminum alloy thick plate, each of positions located at a center portion in the plate thickness direction and at positions of 0.12 Wa, 0.16 Wa, 0.21 Wa, 0.25 Wa, and 0.30 Wa in the plate width direction is observed using an optical microscope with a measurement field of view of 10 mm×10 mm with respect to a section obtained by cutting the aluminum alloy thick plate with a plane perpendicular to the casting direction, crystallized products with a maximum length of 60 μm or more in each of fields of view are extracted, and the numbers (pieces/$cm^2$) of crystallized products with a maximum length of 60 μm or more per unit area are calculated. The maximum value in the calculated values serves as the value B (pieces/$cm^2$) of the aluminum alloy thick plate.

The aluminum alloy thick plate according to the second mode of the present invention is manufactured by, for example, a method for manufacturing an aluminum alloy thick plate according to the second mode of the present invention described below. The method for manufacturing an aluminum alloy thick plate according to the second mode of the present invention described below is a mere example for manufacturing the aluminum alloy thick plate according to the second mode of the present invention, and the aluminum alloy thick plate according to the second mode of the present invention is not limited to one manufactured by the method for manufacturing an aluminum alloy thick plate according to the second mode of the present invention described hereinafter.

A method for manufacturing an aluminum alloy thick plate according to the second mode of the present invention is preferably a method comprising casting an ingot of an aluminum alloy having a composition of an aluminum alloy of an aluminum alloy thick plate according to the present invention by direct chill casting, thereafter facing the ingot, heating the ingot, thereafter subjecting the ingot to hot rolling, and thereafter cutting a hot-rolled product to manufacture the aluminum alloy thick plate, wherein when Wa is a plate width of the aluminum alloy thick plate in a section perpendicular to a casting direction of the manufactured aluminum alloy thick plate, a 0 position is the center in a plate width direction, and a 0.50 Wa position is a plate end in the plate width direction, (iii) a cooling speed for a range of the ingot corresponding to a range of 0.39 Wa to 0.48 Wa at a position in the plate width direction of the manufactured aluminum alloy thick plate is 0.4 to 0.6° C./sec, and (iv) a cooling speed for a range of the ingot corresponding to a range of 0.12 Wa to 0.30 Wa at a position in the plate width direction of the manufactured aluminum alloy thick plate is less than 0.4° C./sec, and the total reduction of the hot rolling is 30 to 60%.

In the method for manufacturing an aluminum alloy thick plate according to the second mode of the present invention, first, direct chill casting is performed to cast an ingot of an aluminum alloy having a composition of the aluminum alloy of the aluminum alloy thick plate according to the present invention.

Direct chill casting of the method for manufacturing an aluminum alloy thick plate according to the second mode of the present invention is performed to cast: (1) an aluminum alloy including Mg of 2.0 to 5.0 mass %, preferably Mg of 2.0 to 4.2 mass %, and Fe of 0.4 mass % or less, preferably Fe of 0.05 to 0.2 mass %, and particularly preferably Fe of 0.1 to 0.2 mass %; or (2) an aluminum alloy including Mg of 2.0 to 5.0 mass %, preferably Mg of 2.0 to 4.2 mass %, Fe of 0.4 mass % or less, preferably Fe of 0.05 to 0.2 mass %, particularly preferably Fe of 0.1 to 0.2 mass %, and one or two or more of Ti of 0.15 mass % or less, Cr of 0.35 mass % or less, Mn of 1.00 mass % or less, and Si of 0.40 mass % or less. Examples of the aluminum alloy casted by direct chill casting of the method for manufacturing an aluminum alloy thick plate according to the second mode of the present invention include: (3) an aluminum alloy including Mg of 2.0 to 5.0 mass %, preferably Mg of 2.0 to 4.2 mass %; and Fe of 0.4 mass % or less, preferably Fe of 0.05 to 0.2 mass %, and particularly preferably Fe of 0.1 to 0.2 mass %, with the balance being unavoidable impurities and Al; and (4) an aluminum alloy including Mg of 2.0 to 5.0 mass %, preferably Mg of 2.0 to 4.2 mass %, Fe of 0.4 mass % or less, preferably Fe of 0.05 to 0.2 mass %, particularly preferably Fe of 0.1 to 0.2 mass %, and one or two or more of Ti of 0.15 mass % or less, Cr of 0.35 mass % or less, Mn of 1.00 mass % or less, and Si of 0.40 mass % or less, with the balance being unavoidable impurities and Al.

In direct chill casting of the method for manufacturing an aluminum alloy thick plate according to the second mode of the present invention, molten metal of an aluminum alloy having a predetermined composition is prepared, and subjected to degassing, inclusion removal, and cooling.

In direct chill casting of the method for manufacturing an aluminum alloy thick plate according to the second mode of the present invention, when Wa is a plate width of the aluminum alloy thick plate in a section perpendicular to a casting direction of the manufactured aluminum alloy thick plate, a 0 position is the center in a plate width direction, and a 0.50 Wa position is a plate end in the plate width direction, (iii) a cooling speed for a range of the ingot corresponding to a range of 0.39 Wa to 0.48 Wa at a position in the plate width direction of the manufactured aluminum alloy thick plate is 0.4 to 0.6° C./sec, and (iv) a cooling speed for a range of the ingot corresponding to a range of 0.12 Wa to 0.30 Wa at a position in the plate width direction of the manufactured aluminum alloy thick plate is less than 0.4° C./sec. In cooling at the time when the ingot is solidified, by setting: (iii) the cooling speed for a range of the ingot corresponding to a range of 0.39 Wa to 0.48 Wa at a position in the plate width direction of the manufactured aluminum alloy thick plate; and (iv) the cooling speed for a range of the ingot corresponding to a range of 0.12 Wa to 0.30 Wa at a position in the plate width direction of the manufactured aluminum alloy thick plate to the ranges described above, it is possible to set the value A of the aluminum alloy thick plate to 700 pieces/$cm^2$ or less, and preferably 500 pieces/$cm^2$ or less, and set the value B of the aluminum alloy thick plate to 1.3 times or more as large as the value A of the aluminum alloy thick plate, and preferably 1.5 times or more as large as the value A. In the portion corresponding to the portion required to have long fatigue life in the frames of decompression vessels, that is, (iii) the range of the ingot corresponding to a range of 0.39 Wa to 0.48 Wa at a position in the plate width direction of the manufactured aluminum alloy thick plate, the cooling speed is set to a fast speed of 0.4 to 0.6° C./sec. In addition, in a portion corresponding to the portion with no relation to the fatigue life in the frames of decompression vessels, that is, (iv) the range of the ingot corresponding to a range of 0.12 Wa to 0.30 Wa at a position in the plate width direction of the manufactured aluminum alloy thick plate, the cooling speed is set to a slow speed less than 0.4° C./sec. These settings reduce: (iii) occurrence of coarse crystallized products in the range of the ingot corresponding to a range of 0.39 Wa to 0.48 Wa at a position in the plate width direction of the manufactured aluminum alloy thick plate; and (iv) concentrates occurrence of the coarse crystallized products on a portion close to the center beyond 0.30 Wa at a position in the plate width direction of the manufactured aluminum alloy thick plate. This structure reduces the value A of the aluminum alloy thick plate to 700 pieces/$cm^2$ or less, and preferably 500 pieces/$cm^2$ or less. In cooling at the time when the ingot is solidified, it is difficult in direct chill casting due to thermal behavior to set (iii) the cooling speed for a range of the ingot corresponding to a range of 0.39 Wa to 0.48 Wa at a position in the plate width direction of the manufactured aluminum alloy thick plate to a speed exceeding 0.6° C./sec. In addition, in the case of setting (iii) the cooling speed for a range of the ingot corresponding to a range of 0.39 Wa to 0.48 Wa at a position in the plate width direction of the manufactured aluminum alloy thick plate to a speed less than 0.4° C./sec, because the cooling speed is too slow, the dendrite arm space (hereinafter referred to as "DAS") becomes coarse, and crystallized products generated in the DAS also become coarse. Consequently, the value A of the aluminum alloy thick plate exceeds 700 pieces/$cm^2$.

In direct chill casting of the method for manufacturing an aluminum alloy thick plate according to the second mode of the present invention, as a method for adjusting the cooling speed in cooling at the time when the ingot is solidified, for example, there is a method of increasing the cooling speed for (iii) the range of the ingot corresponding to a range of 0.39 Wa to 0.48 Wa at a position in the plate width direction of the manufactured aluminum alloy thick plate to 0.4 to 0.6° C./sec, by increasing the temperature gradient in a solidification position corresponding to the center portion in the thickness direction of the ingot, in (iii) the range of the ingot corresponding to a range of 0.39 Wa to 0.48 Wa at a position in the plate width direction of the manufactured aluminum alloy thick plate, that is, employing a strong flow of molten aluminum alloy to the center portion in the thickness direction of the ingot, in the position in the width direction of the ingot in (iii) the range of the ingot corresponding to a range of 0.39 Wa to 0.48 Wa at a position in the plate width direction of the manufactured aluminum alloy thick plate, to decrease the temperature gradient in the solidification process, that is, shorten the liquidus temperature position and the solidus temperature position. Specific methods thereof include setting a plurality of molten metal supply nozzles into the cast such that the strong flow of molten aluminum alloy hits the position, setting an in-cast molten metal distributer to a proper size, and/or causing a strong flow of molten aluminum alloy to hit the position with a molten metal pump set in the cast.

In the method for manufacturing an aluminum alloy thick plate according to the second mode of the present invention, after the ingot acquired by direct chill casting is subjected to facing, the faced ingot is heated at 500 to 550° C., and preferably 510 to 540° C., for the purpose of eliminating micro segregation and performing heating before rolling.

Thereafter, in the method for manufacturing an aluminum alloy thick plate according to the second mode of the present invention, the faced and heated ingot is subjected to hot rolling. In hot rolling in the method for manufacturing an aluminum alloy thick plate according to the present invention, the faced and heated ingot is subjected to hot rolling through a plurality of passes at 400 to 510° C., and preferably 450 to 505° C.

In hot rolling in the method for manufacturing an aluminum alloy thick plate according to the second mode of the present invention, the total reduction is 30 to 60%. The total reduction (%) in hot rolling is a ratio of reduction in plate thickness after the final pass to the plate thickness before the first pass of hot rolling, and is a value calculated with "(plate thickness t1 before first pass−plate thickness t2 after final pass)/plate thickness t1 before first pass×100".

The thickness of the ingot before hot rolling in the method for manufacturing an aluminum alloy thick plate according to the second mode of the present invention is preferably 500 to 750 mm.

Thereafter, in the method for manufacturing an aluminum alloy thick plate according to the second mode of the present invention, the hot-rolled product acquired by hot rolling is cut to acquire the aluminum alloy thick plate according to the present invention.

The present invention will be specifically explained with the following Examples, but the present invention is not limited thereto.

EXAMPLES

Aluminum Alloy Thick Plate According to First Mode of Present Invention

Examples 1 to 17 and Comparative Examples 1 and 2

Ingots with a length of 4,000 mm, width of 2,000 mm, and a thickness of 650 mm were prepared by semi-continuous casting using molten metals of compositions and hydrogen gas quantities illustrated in Table 1. Unsound portions on the casting start side and the end side were removed by cutting, unsound structure in the vicinity of the casting surface was faced, and each of the ingots was heated at 510° C. Thereafter, each of the ingots was subjected to hot rolling with the total reduction of 44% to manufacture aluminum alloy thick plates with a length of 3,200 mm, a width of 2,600 mm, and a thickness of 340 mm. In this state, the cooling speed at the time when each of the ingots was solidified was adjusted such that the cooling speed for a range of the ingot corresponding to a range of 0.39 Wa to 0.48 Wa at a position in the plate width direction of the manufactured aluminum alloy thick plate was set to 0.52° C./sec, and the cooling speed for a range of the ingot corresponding to a range of 0.12 Wa to 0.30 Wa at a position in the plate width direction of the manufactured aluminum alloy thick plate is set to 0.02° C./sec. The cooling speed was calculated by checking the DAS interval on the basis of the taken photograph and converting the DAS interval into the cooling speed.

Thereafter, the value A and the value B of each of the acquired aluminum alloy thick plates were determined. In addition, each of the acquired aluminum alloy thick plates was subjected to tensile test, ductile test, and fatigue life test.

Method for Calculating Value A and Value B of Aluminum Alloy Thick Plate Each of the acquired aluminum alloy thick plates was sliced into a thickness of approximately 30 mm in a direction perpendicular to the casting direction. Thereafter, the acquired cut product was cut with a plane in parallel with the casting direction and the thickness direction, the cut surface was polished, and the center portion in the plate thickness direction was imaged with a continuous field of view of 10 mm×10 mm at the magnification of 50. After imaging with an optical microscope, porosities with an equivalent circle diameter of 50 μm or more in each of positions were extracted using image analysis software from each of images of positions of 0.39 Wa, 0.40 Wa, 0.42 Wa, 0.44 Wa, 0.46 Wa, and 0.48 Wa in the plate width direction, the numbers (pieces/cm$^2$) of porosities with an equivalent circle diameter of 50 μm or more per unit area were calculated, and the maximum value in the calculated numbers was set as A (pieces/cm$^2$). In addition, porosities with an equivalent circle diameter of 50 μm or more in each of positions were extracted using image analysis software from each of images of positions of 0.12 Wa, 0.16 Wa, 0.21 Wa, 0.25 Wa, and 0.30 Wa in the plate width direction, the numbers (pieces/cm$^2$) of porosities per unit area were calculated, and the maximum value in the calculated numbers was set as B (pieces/cm$^2$).

Tensile Test, Ductile Test, and Fatigue Life Test

A test piece was extracted from a portion of each of the acquired aluminum alloy thick plates at a center portion in the plate thickness direction and in a position serving as the position providing the value A in the plate width direction, and subjected to tensile test, ductile test, and fatigue life test. The test piece having tensile strength of 200 MPa or more, ductility (stretch) of 20% or more, and fatigue strength of 9 ksi×5 Mcycle or more was regarded as "passed" (○). Table 1 illustrates the results of the tests.

TABLE 1

| | Mass % | | | | | | Hydrogen Gas Quantity (cc/100 g Al) | 0.39-0.48 Wa Maximum Porosity Number (Value A: pieces/cm$^2$) | 0.12-0.30 Wa Maximum Porosity Number (Value B: pieces/cm$^2$) | Evaluation |
|---|---|---|---|---|---|---|---|---|---|---|
| | Mg | Ti | Cr | Mn | Fe | Si | | | | |
| Example 1 | 2.0 | 0.038 | 0.33 | 0.47 | 0.24 | 0.19 | 0.07 | 68 | 94 | ○ |
| Example 2 | 5.0 | 0.018 | 0.29 | 0.61 | 0.01 | 0.16 | 0.07 | 154 | 267 | ○ |
| Example 3 | 3.2 | 0.005 | 0.12 | 0.23 | 0.27 | 0.25 | 0.07 | 92 | 140 | ○ |
| Example 4 | 3.2 | 0.150 | 0.18 | 0.17 | 0.19 | 0.13 | 0.09 | 100 | 152 | ○ |
| Example 5 | 4.3 | 0.029 | 0.05 | 0.98 | 0.31 | 0.26 | 0.14 | 142 | 235 | ○ |
| Example 6 | 2.5 | 0.020 | 0.35 | 0.23 | 0.10 | 0.19 | 0.15 | 110 | 159 | ○ |
| Example 7 | 4.2 | 0.017 | 0.06 | 0.01 | 0.15 | 0.08 | 0.13 | 136 | 223 | ○ |
| Example 8 | 2.0 | 0.005 | 0.21 | 1.00 | 0.33 | 0.09 | 0.09 | 76 | 105 | ○ |
| Example 9 | 2.6 | 0.014 | 0.10 | 0.02 | 0.01 | 0.11 | 0.15 | 112 | 163 | ○ |
| Example 10 | 2.1 | 0.014 | 0.30 | 0.67 | 0.40 | 0.08 | 0.14 | 98 | 137 | ○ |
| Example 11 | 4.5 | 0.007 | 0.29 | 0.45 | 0.02 | 0.05 | 0.12 | 138 | 231 | ○ |
| Example 12 | 2.2 | 0.019 | 0.29 | 0.90 | 0.14 | 0.40 | 0.15 | 104 | 146 | ○ |
| Example 13 | 4.8 | 0.026 | 0.13 | 0.12 | 0.25 | 0.05 | 0.15 | 156 | 267 | ○ |
| Example 14 | 4.0 | 0.015 | — | — | 0.01 | 0.05 | 0.12 | 128 | 207 | ○ |
| Example 15 | 3.9 | — | 0.30 | — | 0.02 | 0.06 | 0.11 | 122 | 196 | ○ |
| Example 16 | 4.1 | — | — | 0.50 | 0.02 | 0.08 | 0.13 | 134 | 218 | ○ |
| Example 17 | 3.8 | — | — | — | 0.01 | 0.05 | 0.12 | 124 | 198 | ○ |
| Comparative Example 1 | 1.9 | 0.113 | 0.19 | 0.92 | 0.40 | 0.29 | 0.12 | 86 | 118 | X in strength |
| Comparative Example 2 | 5.1 | 0.015 | 0.24 | 0.42 | 0.18 | 0.36 | 0.14 | 162 | 283 | X in fatigue strength |

On the basis of the results described above, Examples 1 to 17 were materials each having the value A and the value B satisfying the prescribed values, and excellent in strength, stretch, and fatigue strength.

By contrast, Comparative Example 1 had low strength, because the Mg content thereof was less than 2.0 mass %.

In addition, Comparative Example 2 had low fatigue strength, because the Mg content thereof exceeded 5.0 mass %, the solubility of hydrogen in the Al—Mg alloy molten metal increased, and the value A and the value B increased.

Examples 18 to 21 and Comparative Examples 3 and 4

Ingots with a length of 4,000 mm, width of 1,800 mm, and a desired thickness were prepared by semi-continuous casting using molten metals of compositions and hydrogen gas quantities illustrated in Table 2. Unsound portions on the casting start side and the end side were removed by cutting, unsound structure in the vicinity of the casting surface was faced, and each of the ingots was heated at 510° C. Thereafter, each of the ingots was subjected to hot rolling with the total reduction illustrated in Table 2 to manufacture aluminum alloy thick plates with a length of 3,200 mm, a width of 1,800 mm, and a desired thickness. In this state, the cooling speed at the time when each of the ingots was solidified was adjusted such that the cooling speed for a range of the ingot corresponding to a range of 0.39 Wa to 0.48 Wa at a position in the plate width direction of the manufactured aluminum alloy thick plate was set to the speed illustrated in Table 2, and the cooling speed for a range of the ingot corresponding to a range of 0.12 Wa to 0.30 Wa at a position in the plate width direction of the manufactured aluminum alloy thick plate is set to the speed illustrated in Table 2. In addition, adjustment was performed such that the total reduction illustrated in Table 2 was achieved with the thickness of the ingot and the thickness after hot rolling. The cooling speed was calculated by checking the DAS interval on the basis of the taken photograph and converting the DAS interval into the cooling speed.

Thereafter, the value A and the value B of each of the acquired aluminum alloy thick plates were determined. In addition, each of the acquired aluminum alloy thick plates was subjected to tensile test, ductile test, and fatigue life test. Table 2 illustrates the results of the tests.

In this state, the cooling speed at the time when each of the ingots was solidified was adjusted such that the cooling speed for a range of the ingot corresponding to a range of 0.39 Wa to 0.48 Wa at a position in the plate width direction of the manufactured aluminum alloy thick plate was set to 0.52° C./sec, and the cooling speed for a range of the ingot corresponding to a range of 0.12 Wa to 0.30 Wa at a position in the plate width direction of the manufactured aluminum alloy thick plate is set to 0.02° C./sec. The cooling speed was calculated by checking the DAS interval on the basis of the taken photograph and converting the DAS interval into the cooling speed.

Thereafter, the value A and the value B of each of the acquired aluminum alloy thick plates were determined. In addition, each of the acquired aluminum alloy thick plates was subjected to tensile test, ductile test, and fatigue life test.

TABLE 2

| | wt % | | | | | | Hydrogen Gas Quantity (cc/100 | Cooling Speed (° C./s) for a Range Corre-sponding to 0.39 to 0.48 | Cooling Speed (° C./s) for a Range Corre-sponding to 0.12 to 0.30 | Total Reduction of Hot Rolling | 0.39-0.48 Wa Maximum Porosity Number (Value A: | 0.12-0.30 Wa Maximum Porosity Number (Value B: | Evalua- |
|---|---|---|---|---|---|---|---|---|---|---|---|---|---|
| | Mg | Ti | Cr | Mn | Fe | Si | g Al) | Wa | Wa | (%) | pieces/cm$^2$) | pieces/cm$^2$) | tion |
| Example 18 | 4.1 | 0.150 | 0.07 | 0.50 | 0.10 | 0.05 | 0.13 | 0.40 | 0.35 | 45 | 152 | 248 | ○ |
| Example 19 | | | | | | | | 0.60 | 0.07 | 45 | 111 | 128 | ○ |
| Example 20 | | | | | | | | 0.42 | 0.39 | 45 | 144 | 166 | ○ |
| Example 21 | | | | | | | | 0.56 | 0.14 | 30 | 142 | 178 | ○ |
| Comparative Example 3 | | | | | | | | 0.30 | 0.38 | 45 | 171 | 187 | X in fatigue strength |
| Comparative Example 4 | | | | | | | | 0.70 | 0.01 | — | — | — | Casting failed |

On the basis of the results described above, Examples 18 to 21 were materials each having the value A and the value B satisfying the prescribed values, and excellent in strength, stretch, and fatigue strength.

By contrast, Comparative Example 3 was performed by a conventional casting method in which no molten metal quantity hitting the solidification interface was adjusted using the molten metal pump. Because the cooling speed in a corresponding position of the ingot serving as the target of the value A was slow, the value A was large, and the fatigue life thereof was short.

In addition, in Comparative Example 4, when the molten metal pump was adjusted to further increase the cooling speed in the corresponding position of the ingot serving as the target of the value A, the casting surface was molten in the ingot casting surface portion due to change in flow in the sump during casting, and casting ended in failure.

Aluminum Alloy Thick Plate According to Second Form of Present Invention

Examples 22 to 39 to Comparative Examples 5 to 7

Ingots with a length of 4,000 mm, a width of 2,000 mm, and a thickness of 650 mm were prepared by semi-continuous casting using molten metals of compositions illustrated in Table 3. Unsound portions on the casting start side and the end side were removed by cutting, unsound structure in the vicinity of the casting surface was faced, and each of the ingots was heated at 510° C. Thereafter, each of the ingots was subjected to hot rolling with the total reduction of 44% to manufacture aluminum alloy thick plates with a length of 3,200 mm, a width of 2,600 mm, and a thickness of 340 mm.

Method for Calculating Value A and Value B of Aluminum Alloy Thick Plate

Each of the acquired aluminum alloy thick plates was sliced into a thickness of approximately 30 mm in a direction perpendicular to the casting direction. Thereafter, the acquired cut product was cut with a plane in parallel with the casting direction and the thickness direction, the cut surface was polished, and the center portion in the plate thickness direction was imaged with a continuous field of view of 10 mm×10 mm at the magnification of 50 using an optical microscope. After imaging with the optical microscope, crystallized products with a maximum length of 60 μm or more in each of positions were extracted using image analysis software from each of images of positions of 0.39 Wa, 0.40 Wa, 0.42 Wa, 0.44 Wa, 0.46 Wa, and 0.48 Wa in the plate width direction, the numbers (pieces/cm$^2$) of crystallized products with a maximum length of 60 μm or more per unit area were calculated, and the maximum value in the calculated numbers was set as A (pieces/cm$^2$). In addition, crystallized products with a maximum length of 60 μm or more in each of positions were extracted using image analysis software from each of images of positions of 0.12 Wa, 0.16 Wa, 0.21 Wa, 0.25 Wa, and 0.30 Wa in the plate width direction, the numbers (pieces/cm$^2$) of crystallized products per unit area were calculated, and the maximum value in the calculated numbers was set as B (pieces/cm$^2$).

Tensile Test, Ductile Test, and Fatigue Life Test

A test piece was extracted from a portion of each of the acquired aluminum alloy thick plates at a center portion in the plate thickness direction and in a position serving as the position providing the value A in the plate width direction, and subjected to tensile test, ductile test, and fatigue life test. The test piece having tensile strength of 200 MPa or more, ductility (stretch) of 20% or more, and fatigue strength of 9 ksi×5 Mcycle or more was regarded as "passed" (○). Table 1 illustrates the results of the tests.

TABLE 3

| | Mass % | | | | | | 0.39-0.48 Wa Maximum Crystallized Product Number (Value A: | 0.12-0.30 Wa Maximum Crystallized Product Number (Value B: | |
|---|---|---|---|---|---|---|---|---|---|
| | Mg | Fe | Ti | Cr | Mn | Si | pieces/cm$^2$) | pieces/cm$^2$) | Evaluation |
| Example 22 | 2.0 | 0.36 | 0.072 | 0.06 | 0.03 | 0.36 | 517 | 894 | ○ |
| Example 23 | 5.0 | 0.13 | 0.105 | 0.29 | 0.05 | 0.24 | 566 | 747 | ○ |
| Example 24 | 2.4 | 0.12 | 0.029 | 0.35 | 0.43 | 0.32 | 414 | 544 | ○ |
| Example 25 | 2.5 | 0.38 | 0.045 | 0.00 | 0.40 | 0.19 | 590 | 1,061 | ○ |
| Example 26 | 3.4 | 0.25 | 0.005 | 0.03 | 0.53 | 0.32 | 397 | 548 | ○ |
| Example 27 | 4.2 | 0.20 | 0.149 | 0.30 | 0.92 | 0.33 | 663 | 1,040 | ○ |
| Example 28 | 2.7 | 0.33 | 0.022 | 0.01 | 0.60 | 0.09 | 471 | 747 | ○ |
| Example 29 | 3.6 | 0.10 | 0.101 | 0.34 | 0.15 | 0.05 | 554 | 721 | ○ |
| Example 30 | 2.3 | 0.29 | 0.103 | 0.14 | 0.41 | 0.15 | 387 | 555 | ○ |
| Example 31 | 2.8 | 0.17 | 0.128 | 0.01 | 1.00 | 0.04 | 609 | 953 | ○ |
| Example 32 | 4.4 | 0.34 | 0.018 | 0.09 | 0.68 | 0.06 | 695 | 1,005 | ○ |
| Example 33 | 3.9 | 0.15 | 0.009 | 0.13 | 0.81 | 0.39 | 511 | 842 | ○ |
| Example 34 | 2.9 | 0.10 | 0.004 | 0.23 | 0.70 | 0.11 | 441 | 579 | ○ |
| Example 35 | 4.2 | 0.27 | 0.046 | 0.01 | 0.62 | 0.22 | 388 | 583 | ○ |
| Example 36 | 2.2 | 0.13 | 0.023 | 0.25 | 0.33 | 0.31 | 487 | 634 | ○ |
| Example 37 | 4.7 | 0.30 | 0.110 | 0.31 | 0.89 | 0.34 | 690 | 1,109 | ○ |
| Example 38 | 3.3 | 0.14 | 0.003 | 0.01 | 0.32 | 0.03 | 347 | 471 | ○ |
| Example 39 | 3.2 | 0.09 | 0.045 | 0.08 | 0.12 | 0.05 | 307 | 431 | ○ |
| Comparative Example 5 | 1.9 | 0.14 | 0.113 | 0.19 | 0.63 | 0.19 | 488 | 654 | X in strength |
| Comparative Example 6 | 5.1 | 0.34 | 0.089 | 0.24 | 0.90 | 0.36 | 708 | 1,055 | X in fatigue strength |
| Comparative Example 7 | 4.3 | 0.41 | 0.081 | 0.29 | 0.65 | 0.38 | 712 | 1,008 | X in fatigue strength |

On the basis of the results described above, Examples 22 to 39 were materials each having the value A and the value B satisfying the prescribed values, and excellent in strength, stretch, and fatigue strength.

By contrast, Comparative Example 5 had low strength, because the Mg content thereof was less than 2.0 mass %.

Comparative Example 6 had low fatigue strength, because the Mg content thereof exceeded 5.0 mass %, Al—Mg—Si-based crystallized products and Mg—Si-based crystallized products in the aluminum alloy increased, and the value A and the value B increased.

Comparative Example 7 had low fatigue strength, because the Fe content thereof exceeded 0.4 mass %, Al—Fe-based crystallized products, Al—Fe—Mn-based crystallized products, and Al—Fe—Si-based crystallized products in the aluminum alloy increased, and the value A and the value B increased.

Examples 40 to 43 and Comparative Examples 8 and 9

Ingots with a length of 4,000 mm, a width of 1,800 mm, and a desired thickness were prepared by semi-continuous casting using molten metals of compositions illustrated in Table 4. Unsound portions on the casting start side and the end side were removed by cutting, unsound structure in the vicinity of the casting surface was faced, and each of the ingots was heated at 510° C. Thereafter, each of the ingots was subjected to hot rolling with the total reduction illustrated in Table 4 to manufacture aluminum alloy thick plates with a length of 3,200 mm, a width of 1,800 mm, and a desired thickness. In this state, the cooling speed at the time when each of the ingots was solidified was adjusted such that the cooling speed for a range of the ingot corresponding to a range of 0.39 Wa to 0.48 Wa at a position in the plate width direction of the manufactured aluminum alloy thick plate was set to the speed illustrated in Table 4, and the cooling speed for a range of the ingot corresponding to a range of 0.12 Wa to 0.30 Wa at a position in the plate width direction of the manufactured aluminum alloy thick plate is set to the speed illustrated in Table 4. In addition, adjustment was performed such that the total reduction illustrated in Table 4 was achieved with the thickness of the ingot and the thickness after hot rolling. The cooling speed was calculated by checking the DAS interval on the basis of the taken photograph and converting the DAS interval into the cooling speed.

Thereafter, the value A and the value B of each of the acquired aluminum alloy thick plates were determined. In addition, each of the acquired aluminum alloy thick plates was subjected to tensile test, ductile test, and fatigue life test. Table 4 illustrates the results of the tests.

TABLE 4

| | wt % | | | | | | Cooling Speed (° C./s) for a Range Corresponding to 0.39 to 0.48 | Cooling Speed (° C./s) for a Range Corresponding to 0.12 to 0.30 | Total Reduction of Hot Rolling | 0.39-0.48 Wa Maximum Crystallized Products Number (Value A: | 0.12-0.30 Wa Maximum Crystallized Products Number (Value B: | |
|---|---|---|---|---|---|---|---|---|---|---|---|---|
| | Mg | Fe | Ti | Cr | Mn | Si | Wa | Wa | (%) | pieces/cm$^2$) | pieces/cm$^2$) | Evaluation |
| Example 40 | 4.0 | 0.15 | 0.100 | 0.10 | 0.70 | 0.10 | 0.40 | 0.35 | 45 | 603 | 922 | ○ |
| Example 41 | | | | | | | 0.60 | 0.1 | 45 | 322 | 580 | ○ |
| Example 42 | | | | | | | 0.42 | 0.39 | 60 | 579 | 755 | ○ |
| Example 43 | | | | | | | 0.56 | 0.14 | 30 | 346 | 618 | ○ |
| Comparative Example 8 | | | | | | | 0.38 | 0.3 | 45 | 710 | 908 | X in fatigue strength |
| Comparative Example 9 | | | | | | | 0.70 | 0.01 | — | — | — | Casting failed |

On the basis of the results described above, Examples 40 to 43 were materials each having the value A and the value B satisfying the prescribed values, and excellent in strength, stretch, and fatigue strength.

By contrast, Comparative Example 8 was performed by a conventional casting method in which no molten metal quantity hitting the solidification interface was adjusted using the molten metal pump. Because the cooling speed in a corresponding position of the ingot serving as the target of the value A was slow, the value A was large, and the fatigue life thereof was short.

In addition, in Comparative Example 9, when the molten metal pump was adjusted to further increase the cooling speed in the corresponding position of the ingot serving as the target of the value A, the casting surface was molten in the ingot casting surface portion due to change in flow in the sump during casting, and casting ended in failure.

The invention claimed is:

1. An aluminum alloy thick plate comprising an aluminum alloy including Mg of 2.0 to 5.0 mass % and Fe of 0.4 mass % or less, wherein the aluminum alloy thick plate has a plate thickness of 300 to 400 mm, and A is 700 pieces/cm$^2$ or less and B is 1.3 times or more as large as A, when Wa is a plate width of the aluminum alloy thick plate in a section perpendicular to a casting direction and to the plate thickness, wherein the casting direction is a direction in which an ingot of the aluminum alloy serving as a raw material of the aluminum alloy thick plate is drawn in casting, a 0 position is a center in a plate width direction, a 0.50 Wa position represents each of plate ends in the plate width direction, where (i) A, in pieces/cm$^2$, is a maximum value in numbers per unit area of crystallized intermetallic compounds with a maximum length of 60 μm or more measured in each of positions located at a center portion in a plate thickness direction and at positions of 0.39 Wa, 0.40 Wa, 0.42 Wa, 0.44 Wa, 0.46 Wa, and 0.48 Wa between the 0 position and each 0.50 Wa position in the plate width direction; and (ii) B, in pieces/cm$^2$, is a maximum value in numbers per unit area of crystallized intermetallic compounds with a maximum length of 60 μm or more measured in each of positions located at the center portion in the plate thickness direction and at positions of 0.12 Wa, 0.16 Wa, 0.21 Wa, 0.25 Wa, and 0.30 Wa between the 0 position and each 0.50 Wa position in the plate width direction.

2. The aluminum alloy thick plate according to claim 1, wherein the aluminum alloy includes one or more of Ti of 0.15 mass % or less, Cr of 0.35 mass % or less, Mn of 1.00 mass % or less, and Si of 0.40 mass % or less.

* * * * *